US011370011B2

(12) United States Patent
Iwase et al.

(10) Patent No.: US 11,370,011 B2
(45) Date of Patent: Jun. 28, 2022

(54) DEVICE FOR MANUFACTURING BENT PIPE AND METHOD FOR MANUFACTURING BENT PIPE

(71) Applicant: FUTABA INDUSTRIAL CO., LTD., Aichi (JP)

(72) Inventors: Hiro Iwase, Aichi (JP); Koichiro Yamamoto, Aichi (JP); Takashi Sakurai, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 0 days.

(21) Appl. No.: 17/094,162

(22) Filed: Nov. 10, 2020

(65) Prior Publication Data

US 2021/0187574 A1 Jun. 24, 2021

(30) Foreign Application Priority Data

Dec. 18, 2019 (JP) ..... JP2019-228440

(51) Int. Cl.
*B21D 9/05* (2006.01)
*B21C 37/15* (2006.01)

(52) U.S. Cl.
CPC ..... *B21D 9/05* (2013.01); *B21C 37/15* (2013.01)

(58) Field of Classification Search
CPC . B21D 7/024; B21D 9/01; B21D 9/05; B21D 9/073; B21D 11/07; B21C 3/16; B21C 37/15; B21B 17/02
See application file for complete search history.

(56) References Cited

U.S. PATENT DOCUMENTS 2,355,734 A * 8/1944 Katz ..... B21C 3/16 72/283
2,776,697 A * 1/1957 Zerlaut ..... B21D 9/03 72/466

(Continued)

FOREIGN PATENT DOCUMENTS

JP S60234723 A 11/1985
JP H09264128 A 10/1997

(Continued)

OTHER PUBLICATIONS

Japanese Notice of Reasons for Refusal and English machine translation dated Nov. 9, 2021 for corresponding Japanese Application No. 2019-228440, filed Dec. 18, 2019.

*Primary Examiner* — Teresa M Ekiert
(74) *Attorney, Agent, or Firm* — David D. Brush; Westman, Champlin & Koehler, P.A.

(57) ABSTRACT

Provided is a device for manufacturing a bent pipe, the device being capable of reducing buckling. The device including: an inner core metal arranged inside a first pipe; and a bending mold to bend the first pipe. The inner core metal includes: an inner core metal body; a first inner movable portion coupled to the inner core metal body and swingable around a first rocking shaft orthogonal to a central axis of the inner core metal body; and a second inner movable portion coupled to the first inner movable portion and swingable around a second rocking shaft parallel to the first rocking shaft. The first inner movable portion has an enlarging diameter portion enlarged in diameter toward the second inner movable portion. The bending mold causes an inner surface of the first pipe to press the first inner movable portion and the second inner movable portion.

7 Claims, 10 Drawing Sheets

(56) References Cited

U.S. PATENT DOCUMENTS

| | | | | |
|---|---|---|---|---|
| 4,635,464 | A * | 1/1987 | McGuire, Sr | B21D 9/03 72/466 |
| 5,214,950 | A * | 6/1993 | Grobbenhaar | B21D 9/073 72/150 |
| 5,937,686 | A * | 8/1999 | Arai | B21D 9/073 72/150 |
| 2004/0256095 | A1 | 12/2004 | Yogo | |
| 2005/0160783 | A1* | 7/2005 | Ni | B21D 9/073 72/369 |
| 2014/0000337 | A1* | 1/2014 | Carlo | B21D 9/01 72/466.2 |

FOREIGN PATENT DOCUMENTS

| | | | |
|---|---|---|---|
| JP | H1034247 | A | 2/1998 |
| JP | 4229766 | B2 | 2/2009 |

* cited by examiner

DEVICE FOR MANUFACTURING BENT PIPE AND METHOD FOR MANUFACTURING BENT PIPE

CROSS-REFERENCE TO RELATED APPLICATIONS

This application claims the benefit of Japanese Patent Application No. 2019-228440 filed on Dec. 18, 2019 with the Japan Patent Office, and the entire disclosure of Japanese Patent Application No. 2019-228440 is incorporated herein by reference.

BACKGROUND

The present disclosure relates to a device for manufacturing a bent pipe and a method for manufacturing a bent pipe.

There has been known a method for producing a bent pipe by externally pressing a bending mold against a pipe containing a core metal (i.e. a mandrel) (see Japanese Unexamined Patent Application Publication No. S60-234723). The core metal arranged in the pipe includes a core metal body and a movable portion swingably coupled to the core metal body.

In the above method, the movable portion arranged in the pipe moves so as to follow the pipe during a pipe bending to form a bending shape of the pipe.

SUMMARY

In the bending process using the above-described core metal, the pipe is compressed in an axial direction by the core metal body and the movable portion. Therefore, the compression in the axial direction of the pipe tends to cause buckling (i.e. a wrinkle) in a portion held between the core metal and the bending mold.

One aspect of the present disclosure is to provide a device for manufacturing a bent pipe, the device being capable of reducing buckling when the pipe is bent.

One aspect of the present disclosure is to provide a device for manufacturing a bent pipe, the device including: an inner core metal configured to be arranged inside a first pipe; and a bending mold configured to bend the first pipe containing the inner core metal.

The inner core metal includes: an inner core metal body having a hollow cylindrical shape or a solid cylindrical shape; a first inner movable portion having a hollow cylindrical shape or a solid cylindrical shape, the first inner movable portion being coupled to an end in an axial direction of the inner core metal body, the first inner movable portion being swingable relative to the inner core metal body around a first rocking shaft orthogonal to a central axis of the inner core metal body; and a second inner movable portion having a hollow cylindrical shape or a solid cylindrical shape, the second inner movable portion being coupled to the first inner movable portion on an opposite side of the inner core metal body with the first inner movable portion interposed between the inner core metal body and the second inner movable portion, the second inner movable portion being swingable relative to the first inner movable portion around a second rocking shaft parallel to the first rocking shaft. The first inner movable portion has an enlarging diameter portion enlarged in diameter toward the second inner movable portion. The bending mold is configured to cause an inner surface of the first pipe to press the first inner movable portion and the second inner movable portion.

With this configuration, the first inner movable portion, which is arranged between the inner core metal body and the second inner movable portion, presses an inner surface of the first pipe outward in a radial direction when pulled out from the first pipe. As a result, the buckling generated in the first pipe is flattened, and thus, the buckling during bending the first pipe can be reduced.

In one aspect of the present disclosure, the enlarging diameter portion may be smoothly enlarged in diameter so that an amount of change in an outer diameter per unit length in an axial direction increases toward the second inner movable portion. With this configuration, in the bending process of the first pipe, the inner surface of the first pipe is bent along an outer circumferential surface of the first inner movable portion, and thus, the generation of the buckling can be reduced.

In one aspect of the present disclosure, the device may further include an intermediate core metal configured to be arranged between the first pipe and a second pipe containing the first pipe. The intermediate core metal may include: an intermediate core metal body having a hollow cylindrical shape; and an intermediate movable portion having a hollow cylindrical shape, the intermediate movable portion being coupled to an end in an axial direction of the intermediate core metal body, the intermediate movable portion being swingable relative to the intermediate core metal body around a third rocking shaft orthogonal to a central axis of the intermediate core metal body. This configuration effectively reduces the buckling during the bending process of the double pipe, even though the buckling tends to occur inside the double pipe where the bending mold does not touch during the bending process of the double pipe.

In one aspect of the present disclosure, the second inner movable portion may be smoothly reduced in diameter from an intermediate portion in an axial direction toward each of two ends in the axial direction. This configuration allows the second inner movable portion to come in surface contact with the inner surface of the outer curve in the bent portion of the first pipe, and allows the first inner movable portion to come in surface contact with the inner surface of the inner curve. Thus, flattening of the first pipe can be reduced.

In one aspect of the present disclosure, the first inner movable portion may have a maximum outer diameter equal to a maximum outer diameter of the second inner movable portion. This configuration allows the second inner movable portion to easily abut the inner surface of the outer curve in the bent portion of the first pipe. Thus, the flattening of the first pipe can be reduced.

Another aspect of the present disclosure is to provide a method for manufacturing a bent pipe, the method including: arranging an inner core metal inside a first pipe; and bending the first pipe containing the inner core metal.

The inner core metal includes: an inner core metal body having a hollow cylindrical shape or a solid cylindrical shape; a first inner movable portion having a hollow cylindrical shape or a solid cylindrical shape, the first inner movable portion being coupled to an end in an axial direction of the inner core metal body, the first inner movable portion being swingable relative to the inner core metal body around a first rocking shaft orthogonal to a central axis of the inner core metal body; and a second inner movable portion having a hollow cylindrical shape or a solid cylindrical shape, the second inner movable portion being coupled to the first inner movable portion on an opposite side of the inner core metal body with the first inner movable portion interposed between the inner core metal body and the second inner movable portion, the second inner movable portion being swingable relative to the first inner movable portion around a second rocking shaft parallel to the first rocking shaft. The first inner movable portion has an enlarging diameter portion enlarged in diameter toward the second inner movable portion. An inner surface of the first pipe presses the first inner movable portion and the second inner movable portion during the bending.

With this configuration, the first inner movable portion, which is arranged between the inner core metal body and the second inner movable portion, presses the inner surface of the first pipe outward in the radial direction when pulled out from the first pipe. As a result, the buckling generated in the first pipe is flattened, and thus, the buckling during bending the first pipe can be reduced.

BRIEF DESCRIPTION OF THE DRAWINGS

Hereinafter, an example embodiment of the present disclosure will be described by way of example with reference to the accompanying drawings, in which.

DETAILED DESCRIPTION OF EXEMPLARY EMBODIMENTS

1. First Embodiment

1-1. Configuration

Figure 1:
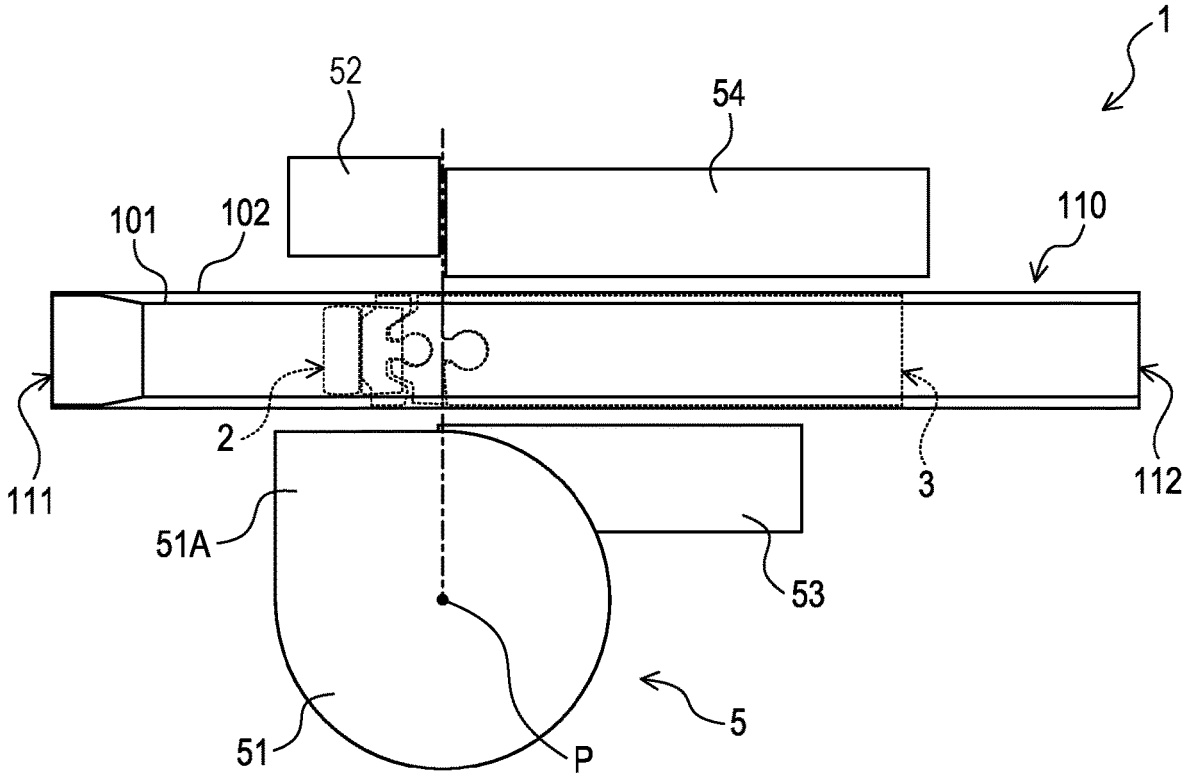
FIG. 1 is a schematic diagram of a device for manufacturing a bent pipe in one embodiment.

A device 1 for manufacturing a bent pipe (hereinafter, simply referred to as "a manufacturing device 1") shown in FIG. 1 is a device to manufacture a bent pipe by bending a straight pipe.

The manufacturing device 1 of the present embodiment manufactures a bent pipe from a double pipe 110 comprises a first pipe 101 and a second pipe 102. The second pipe 102 is arranged so as to surround the outer circumferential surface of the first pipe 101. In other words, the first pipe 101 is arranged inside the second pipe 102. FIG. 1 and other figures show a cross section of the double pipe 110.

The first pipe 101 and the second pipe 102 are joined on a first end 111 of the double pipe 110. On the other hand, the first pipe 101 and the second pipe 102 are not joined on a second end 112 opposite the first end 111.

The first pipe 101 and the second pipe 102 each have a circular outer shape in a cross section orthogonal to a central axis. In the present embodiment, the central axes of the first pipe 101 and the second pipe 102 coincide with each other; however, the central axes of the first pipe 101 and the second pipe 102 may not coincide.

The manufacturing device 1 manufactures a curved double pipe by bending the first pipe 101 and the second pipe 102 at the same time while ensuring a gap between the first pipe 101 and the second pipe 102.

The manufacturing device 1 includes an inner core metal 2, an intermediate core metal 3, and a bending mold 5.

Inner Side Core Metal

Figure 2A:
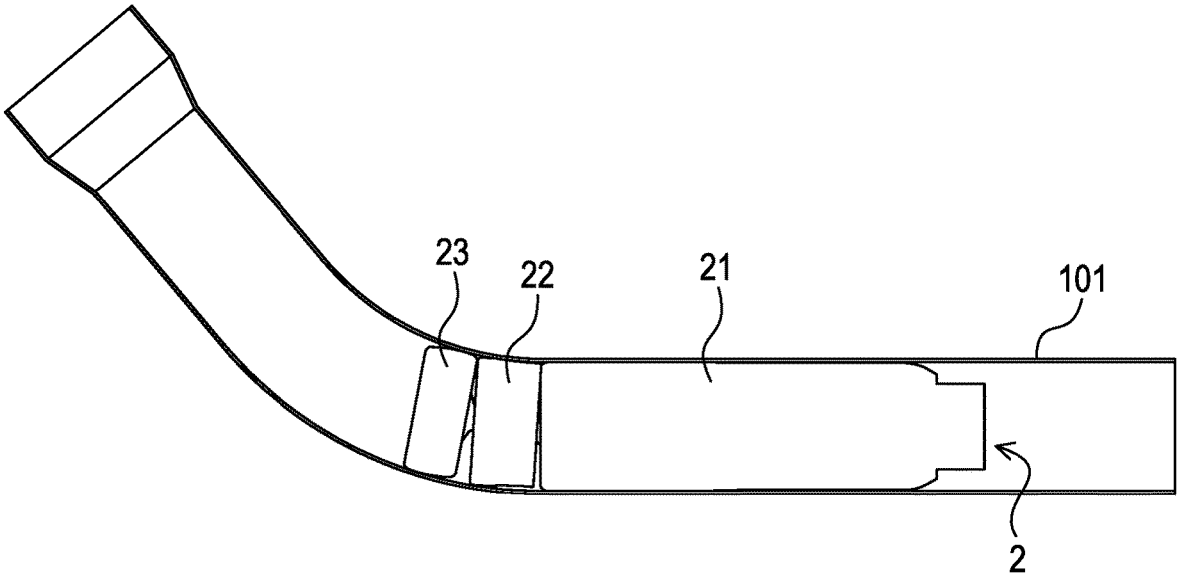
FIG. 2A is a schematic side view of an inner core metal in the device for manufacturing a bent pipe of FIG. 1.

As shown in FIG. 2A, the inner core metal 2 is configured to be arranged inside the first pipe 101.

Figure 2B:
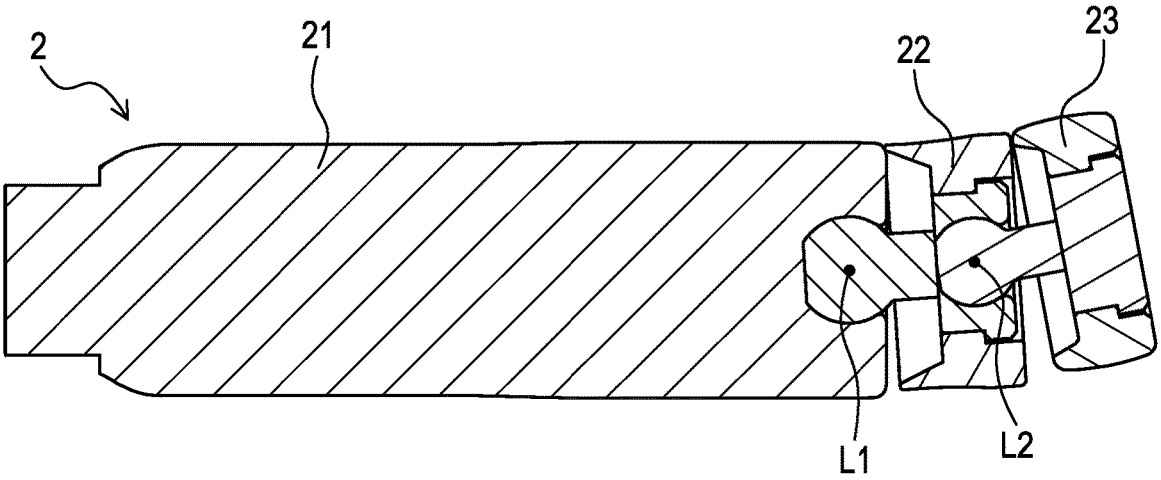
FIG. 2B is a diagram showing a central cross section of the inner core metal of FIG. 2A.

As shown in FIG. 2B, the inner core metal 2 includes an inner core metal body 21, a first inner movable portion 22, and a second inner movable portion 23.

Inner Side Core Metal Body

The inner core metal body 21 has a hollow cylindrical shape or a solid cylindrical shape. The inner core metal body 21 is arranged in a straight portion (i.e. in a non-bent portion) of the double pipe 110.

The inner core metal body 21 has an outer diameter that is constant along an axial direction. The outer diameter of the inner core metal body 21 is substantially equal to an inner diameter of the first pipe 101. The inner core metal body 21 is longer than the first inner movable portion 22 and the second inner movable portion 23 in the axial direction.

First Inner Movable Portion

The first inner movable portion 22 has a hollow cylindrical shape or a solid cylindrical shape, and is coupled to one end in the axial direction of the inner core metal body 21.

The first inner movable portion 22 is swingable relative to the inner core metal body 21 around a first rocking shaft L1 orthogonal to a central axis of the inner core metal body 21. The first rocking shaft L1 passes through an intersection of a straight line including the central axis of the inner core metal body 21 and a straight line including a central axis of the first inner movable portion 22.

Figure 3A:
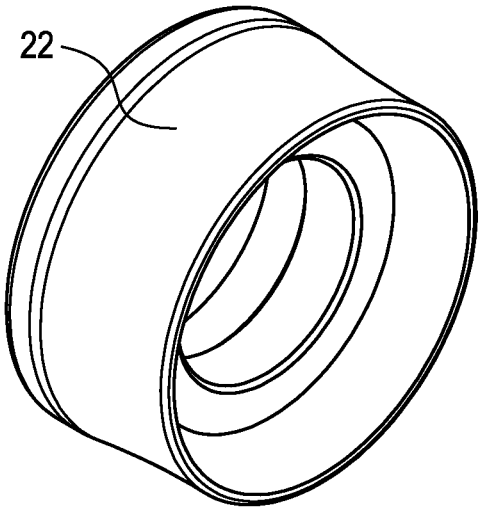
FIG. 3A is a schematic perspective view of a first inner movable portion of the inner core metal of FIG. 2A.
Figure 3B:
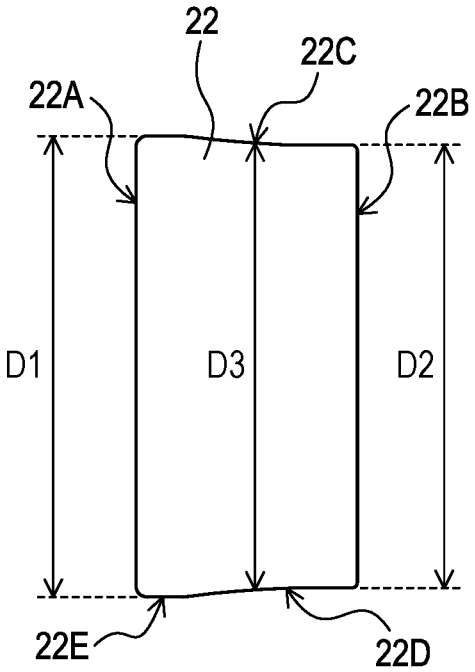
FIG. 3B is a schematic side view of the first inner movable portion of FIG. 3A.
Figure 3C:
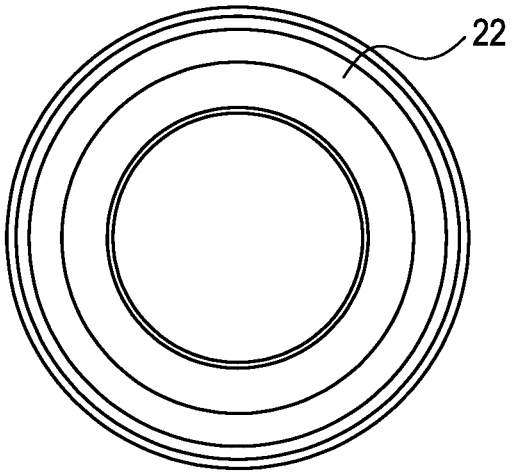
FIG. 3C is a schematic plan view of the first inner movable portion of FIG. 3A.

As shown in FIGS. 3A, 3B, 3C, the first inner movable portion 22 has an outer diameter varied in the axial direction. Specifically, the first inner movable portion 22 includes an enlarging diameter portion 22D smoothly enlarged in diameter toward a first end 22A in the axial direction from a second end 22B in the axial direction, and a straight portion 22E having a constant outer diameter. Here, the term "smoothly" means that an outer circumferential surface is continuous along the axial direction.

The enlarging diameter portion 22D includes the second end 22B. The straight portion 22E includes the first end 22A, and is arranged at a position continuous to the enlarging diameter portion 22D in an axial direction of the first inner movable portion 22.

The enlarging diameter portion 22D has a diameter smoothly enlarged so as to increase an amount of change in an outer diameter per unit length in the axial direction (i.e. a value obtained by differentiating the outer diameter by a distance in the axial direction) toward the second inner movable portion 23 (i.e. toward the first end 22A). In other words, in the enlarging diameter portion 22D, the amount of change in the outer diameter in a region closer to the first end 22A with respect to an intermediate portion 22C in the axial direction is larger than the amount of change in a region closer to the second end 22B with respect to the intermediate portion 22C in the axial direction.

In still other words, the enlarging diameter portion 22D has a curvature of an outer circumferential surface in a cross section including the central axis of the first inner movable portion 22 (i.e. in a central cross section) and the curvature decreases toward the second inner movable portion 23. That is, the outer circumferential surface of the enlarging diameter portion 22D in the central cross section is formed by a part of a circle (i.e. circular arc) whose center is positioned radially outside the outer circumferential surface.

The intermediate portion 22C has a curvature of an outer circumferential surface in the central cross section and the curvature is equal to a curvature of the first pipe 101 that went through a bending process. This reduces buckling in the first pipe 101.

The first end 22A is one of the two ends in the first inner movable portion 22 and is located near the below-described second inner movable portion 23. The second end 22B is the other end located on the opposite side of the first end 22A, that is, near the inner core metal body 21. The intermediate portion 22C is a portion located between the first end 22A and the second end 22B in the axial direction of the first inner movable portion 22.

In the present embodiment, the first end 22A of the first inner movable portion 22 has a first outer diameter D1 (i.e. a maximum outer diameter of the straight portion 22E) larger than a second outer diameter D2 on the second end 22B and a third outer diameter D3 in the intermediate portion 22C. The second outer diameter D2 is smaller than the third outer diameter D3. Furthermore, the first outer diameter D1 is substantially equal to the inner diameter of the first pipe 101.

Due to the above relation between the outer diameters, when the first inner movable portion 22 is pulled out from the first pipe 101 that went through the bending process of the double pipe 110, the buckling generated in a bent portion can be gradually squashed. This reduces pull-out resistance of the first inner movable portion 22 and smoothly flatten the buckling.

The first inner movable portion 22 has a part held inside the inner core metal body 21. The first rocking shaft L1 is positioned inside the inner core metal body 21.

Second Inner Movable Portion

The second inner movable portion 23 has a hollow cylindrical shape or a solid cylindrical shape, and is coupled to the first inner movable portion 22 located on the opposite side of the inner core metal body 21 with the first inner movable portion 22 interposed between the inner core metal body 21 and the second inner movable portion 23.

The second inner movable portion 23 is swingable relative to the first inner movable portion 22 around a second rocking shaft L2 parallel to the first rocking shaft L1 of the first inner movable portion 22. The second rocking shaft L2 passes through an intersection of a straight line including the central axis of the first inner movable portion 22 and a straight line including a central axis of the second inner movable portion 23.

Figure 4A:
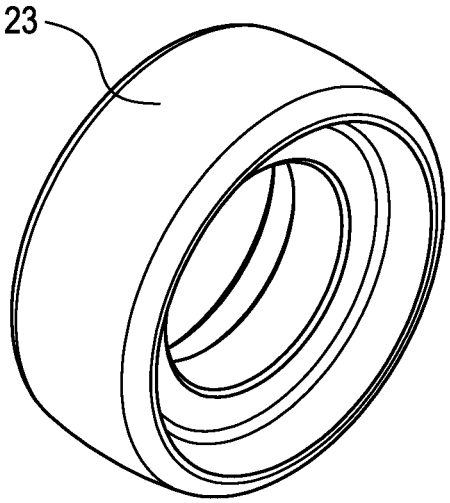
FIG. 4A is a schematic perspective view of a second inner movable portion of the inner core metal of FIG. 2A.
Figure 4B:
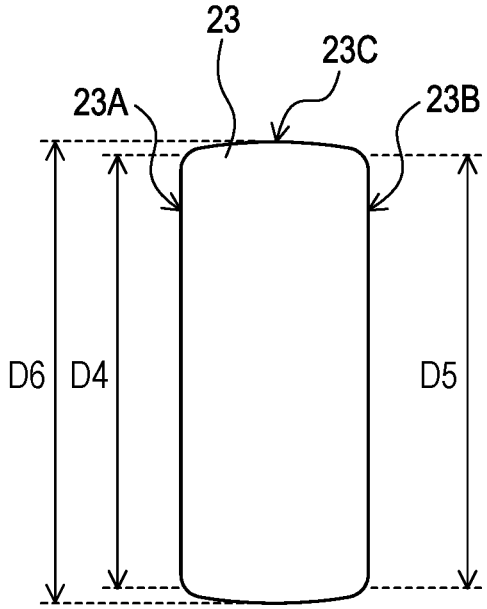
FIG. 4B is a schematic side view of the second inner movable portion of FIG. 4A.
Figure 4C:
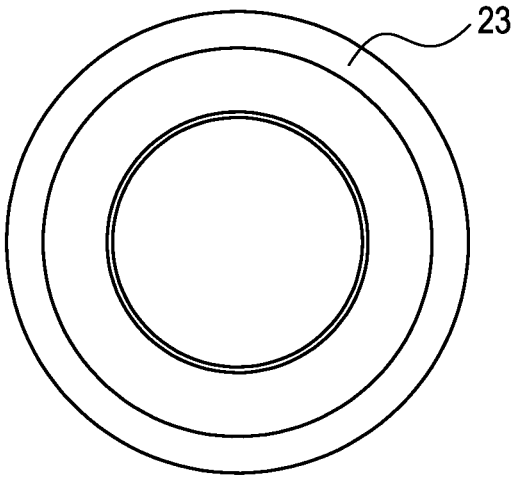
FIG. 4C is a schematic plan view of the second inner movable portion of FIG. 4A.

As shown in FIGS. 4A, 4B, 4C, the second inner movable portion 23 has an outer diameter varied along the axial direction. Specifically, the second inner movable portion 23 is smoothly reduced in diameter from an intermediate portion 23C in the axial direction toward a first end 23A in the axial direction, and is also smoothly reduced in diameter from the intermediate portion 23C toward a second end 23B in the axial direction. In other words, the second inner movable portion 23 has a shape in which the intermediate portion 23C is swelled in a radial direction.

The first end 23A is one of the two ends in the second inner movable portion 23 and is located on the opposite side of the first inner movable portion 22. The second end 23B is the other end located on the opposite side of the first end 23A, that is, near the first inner movable portion 22. The intermediate portion 23C is a portion located between the first end 23A and the second end 23B in an axial direction of the second inner movable portion 23.

In the present embodiment, the second inner movable portion 23 has a fourth outer diameter D4 on the first end 23A and has a fifth outer diameter D5 on the second end 23B, and the fourth outer diameter D4 and the fifth outer diameter D5 are smaller than a sixth outer diameter D6 in the intermediate portion 23C. Furthermore, the fourth outer diameter D4 is equal to the fifth outer diameter D5.

Thus, the second inner movable portion 23 has a symmetrical shape with respect to a virtual plane that is orthogonal to the central axis and that passes through a center point in the axial direction of the second inner movable portion 23. Furthermore, the sixth outer diameter D6 of the second inner movable portion 23 is equal to the first outer diameter D1 of the first inner movable portion 22.

In other words, the maximum outer diameter of the first inner movable portion 22 is equal to a maximum outer diameter of the second inner movable portion 23. Furthermore, the sixth outer diameter D6 of the second inner movable portion 23 and the first outer diameter D1 of the first inner movable portion 22 are equal to the outer diameter of the inner core metal body 21.

The second inner movable portion 23 has a part held inside the first inner movable portion 22. The second rocking shaft L2 is positioned inside the first inner movable portion 22.

Intermediate Core Metal

The intermediate core metal 3 shown in FIG. 1 is configured to be arranged between the first pipe 101 and the second pipe 102.

The intermediate core metal 3 is arranged in a bending portion of the double pipe 110 so as to hold the first pipe 101 in the radial direction with the inner core metal body 21. Also, the intermediate core metal 3 is held in a radial direction of the first pipe 101 between the first pipe 101 and the second pipe 102.

Figure 5:
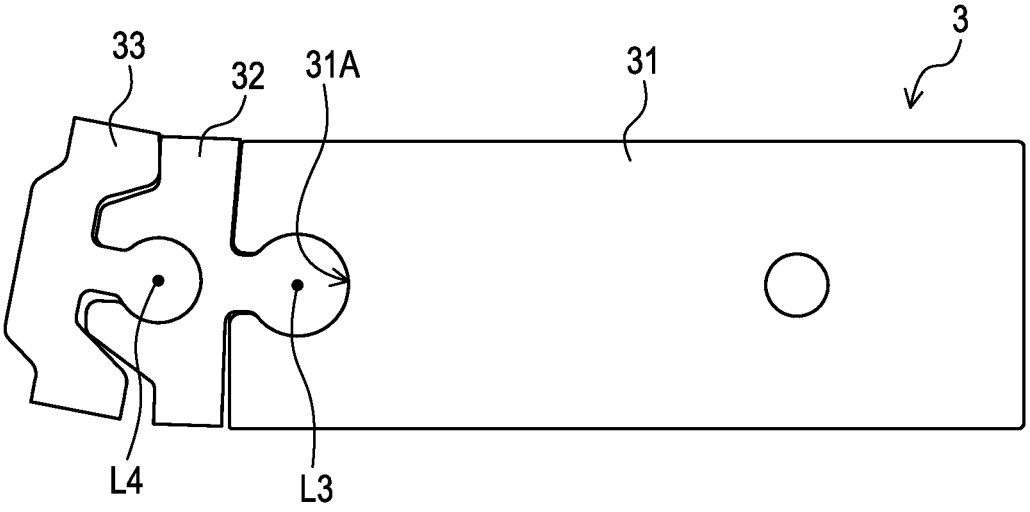
FIG. 5 is a schematic side view of an intermediate core metal in the device for manufacturing a bent pipe of FIG. 1.

As shown in FIG. 5, the intermediate core metal 3 includes an intermediate core metal body 31, a first intermediate movable portion 32, and a second intermediate movable portion 33.

Intermediate Core Metal Body

The intermediate core metal body 31 is a hollow cylindrical member. The intermediate core metal body 31 is arranged in a straight portion of the double pipe 110.

The intermediate core metal body 31 has an inner diameter and an outer diameter that are constant along the axial direction. The inner diameter of the intermediate core metal body 31 is substantially equal to an outer diameter of the first pipe 101. The outer diameter of the intermediate core metal body 31 is substantially equal to an inner diameter of the second pipe 102. The intermediate core metal body 31 is longer than the first intermediate movable portion 32 and the second intermediate movable portion 33 in the axial direction.

The intermediate core metal body 31 includes two engagement receiving portions 31A provided on one end in the axial direction. The engagement receiving portion 31A is a notch recessed inward in an axial direction of the intermediate core metal body 31.

First Intermediate Movable Portion

The first intermediate movable portion 32 is a hollow cylindrical member directly coupled to one end in the axial direction of the intermediate core metal body 31.

As shown in FIG. 5, the first intermediate movable portion 32 is swingable relative to the intermediate core metal body 31 around a third rocking shaft L3 orthogonal to a central axis of the intermediate core metal body 31. The third rocking shaft L3 passes through an intersection of a straight line including the central axis of the intermediate core metal body 31 and a straight line including a central axis of the first intermediate movable portion 32. Furthermore, the third rocking shaft L3 is parallel to the first rocking shaft L1.

Figure 6A:
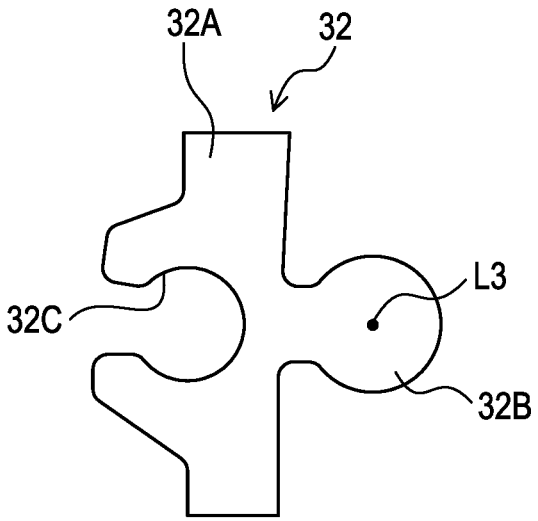
FIG. 6A is a schematic side view of a first intermediate movable portion of the intermediate core metal of FIG. 5.

As shown in FIG. 6A, the first intermediate movable portion 32 includes a ring portion 32A, two engagement portions 32B, and two engagement receiving portions 32C. The ring portion 32A has an inner diameter and an outer diameter that are constant in an axial direction of the first intermediate movable portion 32.

The two engagement portions 32B each protrude toward the intermediate core metal body 31 from the ring portion 32A. The two engagement portions 32B face to each other in a radial direction of the first intermediate movable portion 32. The two engagement portions 32B are each swingably engaged with the engagement receiving portion 31A of the intermediate core metal body 31.

The two engagement receiving portions 32C are each arranged on the opposite side of the end having the engagement portion 32B of the ring portion 32A. The engagement receiving portion 32C is a notch recessed inward in the axial direction of the first intermediate movable portion 32.

Second Intermediate Movable Portion

The second intermediate movable portion 33 is a hollow cylindrical member directly coupled to the first intermediate movable portion 32 on the opposite side of the intermediate core metal body 31 with the first intermediate movable portion 32 interposed between the intermediate core metal body 31 and the second intermediate movable portion 33.

As shown in FIG. 5, the second intermediate movable portion 33 is swingable relative to the first intermediate movable portion 32 around a fourth rocking shaft L4 parallel to the third rocking shaft L3 of the first intermediate movable portion 32. The fourth rocking shaft L4 passes through an intersection of a straight line including the central axis of the first intermediate movable portion 32 and a straight line including a central axis of the second intermediate movable portion 33.

Figure 6B:
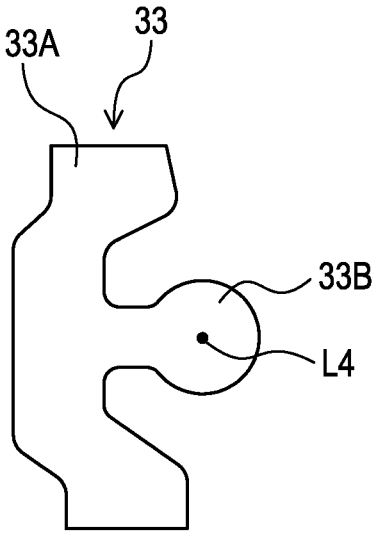
FIG. 6B is a schematic side view of a second intermediate movable portion of the intermediate core metal of FIG. 5.

As shown in FIG. 6B, the second intermediate movable portion 33 includes a ring portion 33A and two engagement portions 33B. The ring portion 33A has an inner diameter and an outer diameter that are constant along an axial direction of the second intermediate movable portion 33.

The two engagement portions 33B each protrude toward the first intermediate movable portion 32 from the ring portion 33A. The two engagement portions 33B face to each other in a radial direction of the second intermediate movable portion 33. The two engagement portions 33B are each swingably engaged with the engagement receiving portion 32C arranged on an end of the first intermediate movable portion 32.

Bending Mold

The bending mold 5 shown in FIG. 1 is configured to bend the double pipe 110 in which the inner core metal 2 and the intermediate core metal 3 are arranged.

Specifically, the bending mold 5 rotates and moves while holding the first pipe 101 and the second pipe 102 in the radial direction with both the inner core metal 2 and the intermediate core metal 3 to bend the first pipe 101 and the second pipe 102. The bending mold 5 includes a rotating portion 51, a clamping portion 52, a sliding portion 53, and a sending portion 54.

The rotating portion 51 is arranged radially outside the bending portion of the double pipe 110. The rotating portion 51 is configured to rotate around a rotation axis P with a chuck portion 51A pressed to an outer circumferential surface of the double pipe 110. The rotation axis P of the rotating portion 51 is parallel to the first rocking shaft L1 of the first inner movable portion 22.

The rotating portion 51 is configured to press an inner surface of the first pipe 101 against the first inner movable portion 22 and the second inner movable portion 23 and to press an inner surface of the second pipe 102 against the first intermediate movable portion 32 and the second intermediate movable portion 33.

The clamping portion 52 is arranged on the opposite side of the rotating portion 51 with the double pipe 110 interposed between the clamping portion 52 and the rotating portion 51. The clamping portion 52 is configured to hold the double pipe 110 with the chuck portion 51A of the rotating portion 51. The clamping portion 52 is swingable around the rotation axis P of the rotating portion 51 in accordance with the rotation of the rotating portion 51.

The sliding portion 53 is arranged adjacent to the rotating portion 51. On the sliding portion 53, an outer circumferential surface of the straight portion of the double pipe 110 slides during the bending process, and the sliding portion 53 serves as a guide to send the double pipe 110 along a rotation direction of the rotating portion 51.

The sending portion 54 is arranged on the opposite side of the sliding portion 53 with the double pipe 110 interposed between the sending portion 54 and the sliding portion 53, and the sending portion 54 is arranged adjacent to the clamping portion 52. The sending portion 54 is configured to move along the central axis while pressing the straight portion of the double pipe 110 in the radial direction. The sending portion 54 sends the double pipe 110 toward the rotating portion 51 while pressing the double pipe 110 against the sliding portion 53.

1-2. Manufacturing Method

Figure 7:
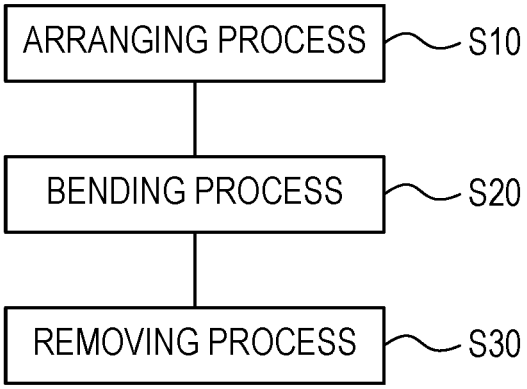
FIG. 7 is a flow diagram of a method for manufacturing a bent pipe in one embodiment.

Hereinafter, a description will be made of a method for manufacturing a bent pipe using the manufacturing device 1 for a bent pipe (shown in FIG. 1). As shown in FIG. 7, the method for manufacturing a bent pipe according to the present embodiment includes an arranging process S10, a bending process S20, and a removing process S30.

Arranging Process

In this process, the inner core metal 2 is arranged inside the first pipe 101, and the intermediate core metal 3 is arranged between the first pipe 101 and the second pipe 102. Specifically, the double pipe 110 is inserted in the axial direction toward the inner core metal 2 and the intermediate core metal 3 that are held between the rotating portion 51 and the clamping portion 52 of the bending mold 5.

In this process, the inner core metal 2 is held so that the central axes of the inner core metal body 21, the first inner movable portion 22 and the second inner movable portion 23 are aligned on the same straight line. Similarly, the intermediate core metal 3 is held so that the central axes of the intermediate core metal body 31, the first intermediate movable portion 32 and the second intermediate movable portion 33 are aligned on the same straight line.

The first inner movable portion 22 is arranged so that at least a part of the first inner movable portion 22 overlaps with the intermediate core metal 3 in the radial direction of the first pipe 101. The second inner movable portion 23 is arranged so as not to overlap with the intermediate core metal 3 in the radial direction of the first pipe 101.

Bending Process

In this process, the first pipe 101 and the second pipe 102, which contain the arranged inner core metal 2 and the intermediate core metal 3, are bent.

Figure 8A:
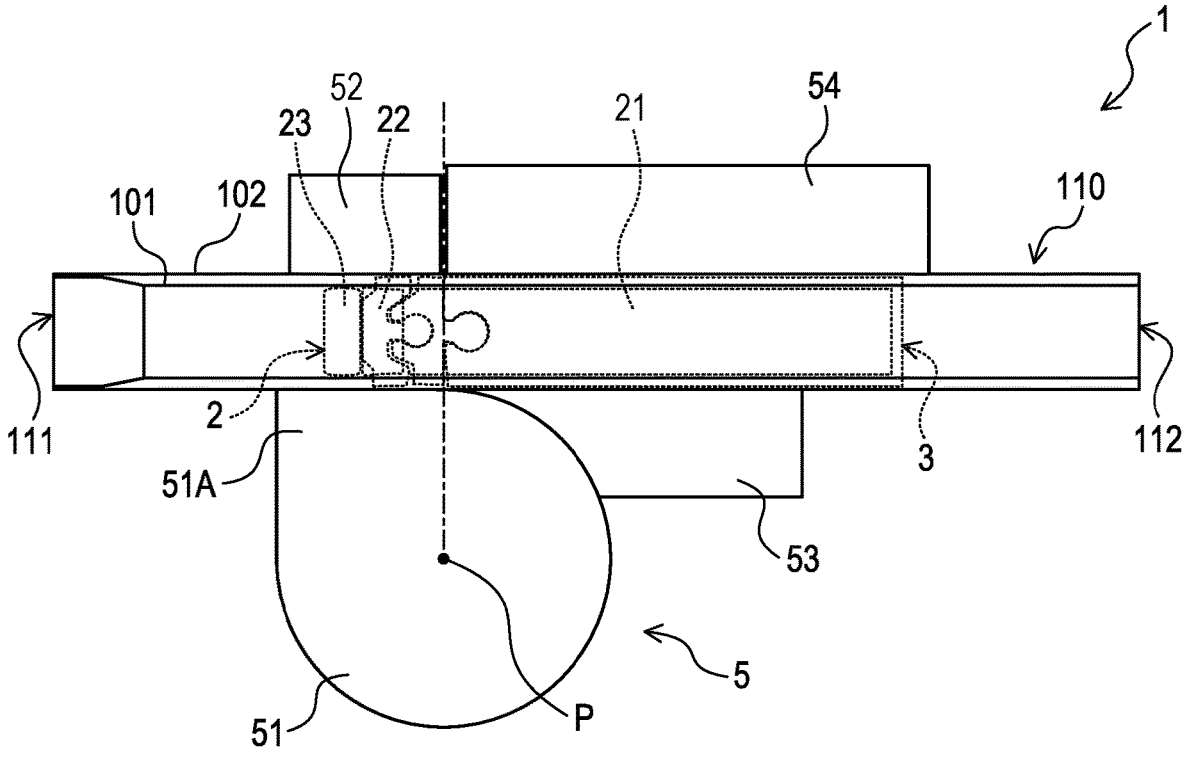
FIG. 8A is a schematic diagram explaining a process of the method for manufacturing a bent pipe of FIG. 7.

Specifically, as shown in FIG. 8A, the clamping portion 52 and the sending portion 54 firstly press the double pipe 110 in the radial direction. With this pressing, the double pipe 110, together with the inner core metal 2 and the intermediate core metal 3, slides in the radial direction toward the rotating portion 51. The double pipe 110 is pressed against the chuck portion 51A of the rotating portion 51 by the clamping portion 52, and pressed against the sliding portion 53 by the sending portion 54.

Figure 8B:
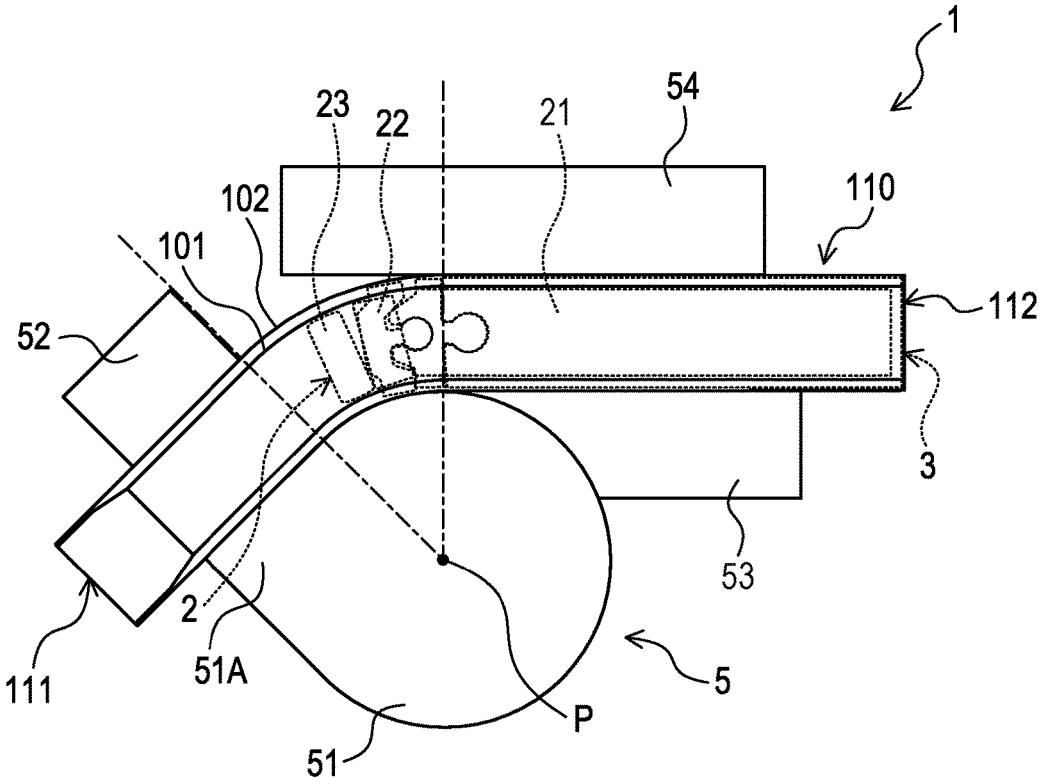
FIG. 8B is a schematic diagram explaining a subsequent process after FIG. 8A.

Then, as shown in FIG. 8B, the rotating portion 51 is rotated in a direction separating the chuck portion 51A from the sliding portion 53 (i.e. toward the first end 111), and the sending portion 54 is slid in a direction following the clamping portion 52.

This allows the chuck portion 51A and the clamping portion 52 to slide on the outer circumferential surface of the double pipe 110 toward the first end 111 while holding the double pipe 110 between the chuck portion 51A and the clamping portion 52. As a result, a portion of the double pipe 110 held between the chuck portion 51A and the clamping portion 52 is plastically deformed so as to curve around the rotation axis P of the rotating portion 51.

Figure 9:
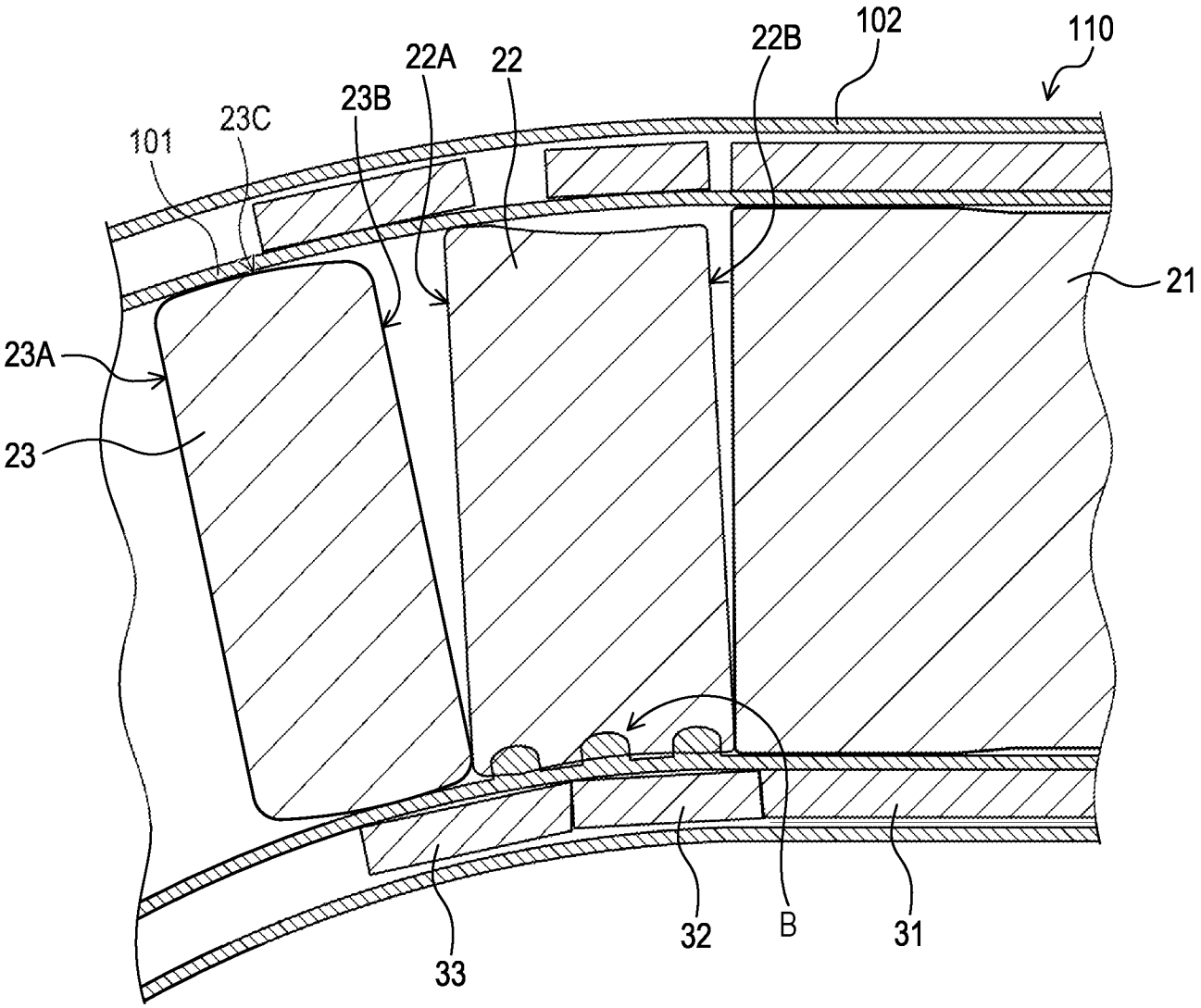
FIG. 9 is a schematic sectional view showing the inner core metal and the intermediate core metal during a bending process.

As shown in FIG. 9, in accordance with the bending of the double pipe 110 by the rotation of the rotating portion 51, the first inner movable portion 22 swings relative to the inner core metal body 21 in a direction where the first end 22A approaches the rotation axis P of the rotating portion 51.

Inside the curved first pipe 101, the first end 22A of the first inner movable portion 22 abuts the inner surface of the first pipe 101 in an inner curve (i.e. on a side closer to the rotation axis P in the radial direction of the first pipe 101) and in an outer curve (i.e. on a side far from the rotation axis P in the radial direction of the first pipe 101).

The second end 22B of the first inner movable portion 22 abuts the inner surface of the first pipe 101 in the inner curve; however, the second end 22B of the first inner movable portion 22 is separated from the inner surface of the first pipe 101 in the outer curve. Furthermore, the second end 22B abuts the end of the inner core metal body 21 in the inner curve.

Similarly, in accordance with the bending of the double pipe 110 by the rotation of the rotating portion 51, the second inner movable portion 23 swings relative to the first inner movable portion 22 in a direction where the first end 23A approaches the rotation axis P.

In the curved first pipe 101, the first end 23A of the second inner movable portion 23 abuts the inner surface of the first pipe 101 in the outer curve; however, the first end 23A is separated from the inner surface of the first pipe 101 in the inner curve.

The second end 23B of the second inner movable portion 23 is separated from the inner surface of the first pipe 101 in the inner curve and the outer curve. In addition, the second end 23B abuts the first end 22A of the first inner movable portion 22 in the inner curve. On the other hand, the intermediate portion 23C of the second inner movable portion 23 abuts the inner surface of the first pipe 101 in the inner curve and the outer curve.

In this way, the first inner movable portion 22 is in surface contact with the inner surface of the first pipe 101 in the inner curve between the first end 22A and the second end 22B. The second inner movable portion 23 is in surface contact with the inner surface of the first pipe 101 in the outer curve between the first end 23A and the intermediate portion 23C.

In accordance with the bending of the double pipe 110 by the rotation of the rotating portion 51, the first intermediate movable portion 32 and the second intermediate movable portion 33 each swing so as not to generate a gap therebetween in the axial direction in the inner curve. In other words, the first intermediate movable portion 32 and the second intermediate movable portion 33 each move inside the curved second pipe 102 to a position not generating a gap in a region facing an outer surface of the first pipe 101 in the inner curve.

The inner core metal body 21 and the intermediate core metal body 31 are held so as not to be moved during the bending process. Accordingly, the double pipe 110 is moved while sliding relative to the inner core metal 2 and the intermediate core metal 3 and while extending in a direction of movement of the clamping portion 52.

Removing Process

In this process, the double pipe 110 that has gone through the bending process is removed from the inner core metal 2, the intermediate core metal 3 and the bending mold 5.

Figure 10A:
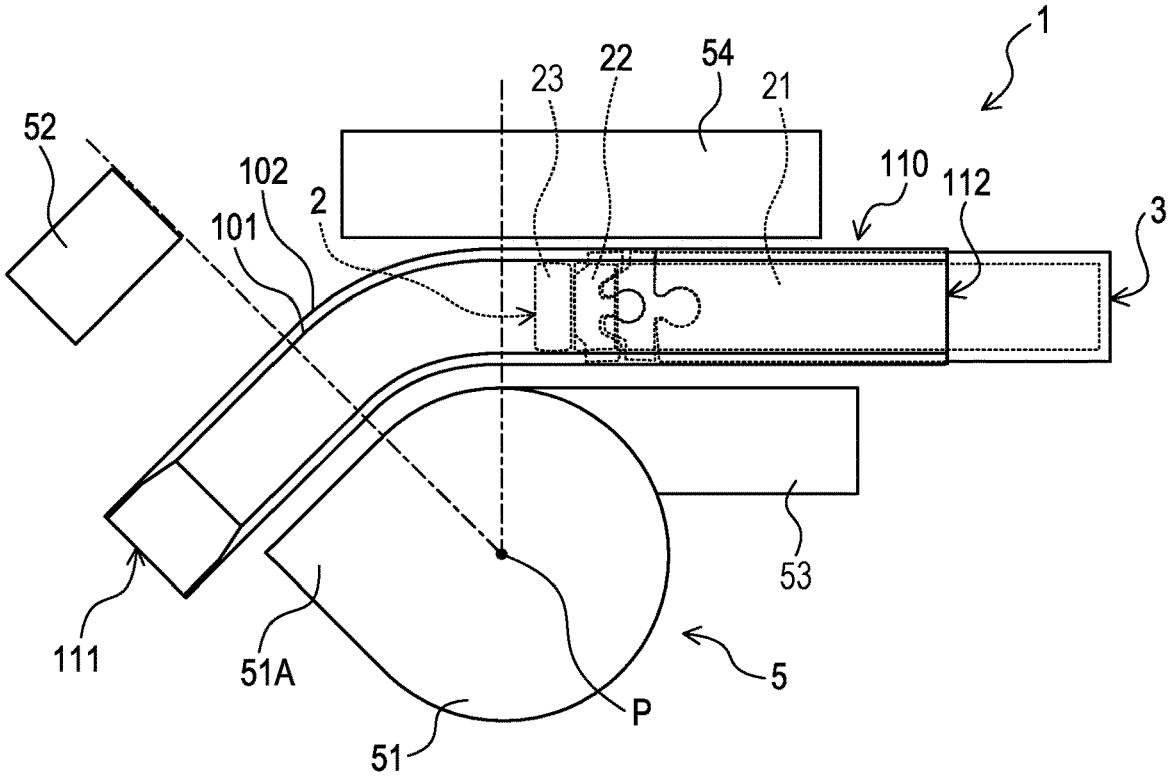
FIG. 10A is a schematic diagram explaining a subsequent process after FIG. 8B.

Specifically, as shown in FIG. 10A, the inner core metal 2 and the intermediate core metal 3 are firstly pulled back. Then, the clamping portion 52 and the sending portion 54 are separated from the double pipe 110 in the radial direction and the double pipe 110 is separated from the rotating portion 51 and the sliding portion 53.

Thereafter, the inner core metal 2 and the intermediate core metal 3 are pulled out from the second end 112 to a position where the inner core metal 2 and the intermediate core metal 3 do not overlap with the bending portion of the double pipe 110. During this process, a buckling B (see FIG. 9) generated on the inner surface of the first pipe 101 in the inner curve is pressed by the outer surface of the first inner movable portion 22 when pulled out, and thus, the buckling B is smoothed.

Figure 10B:
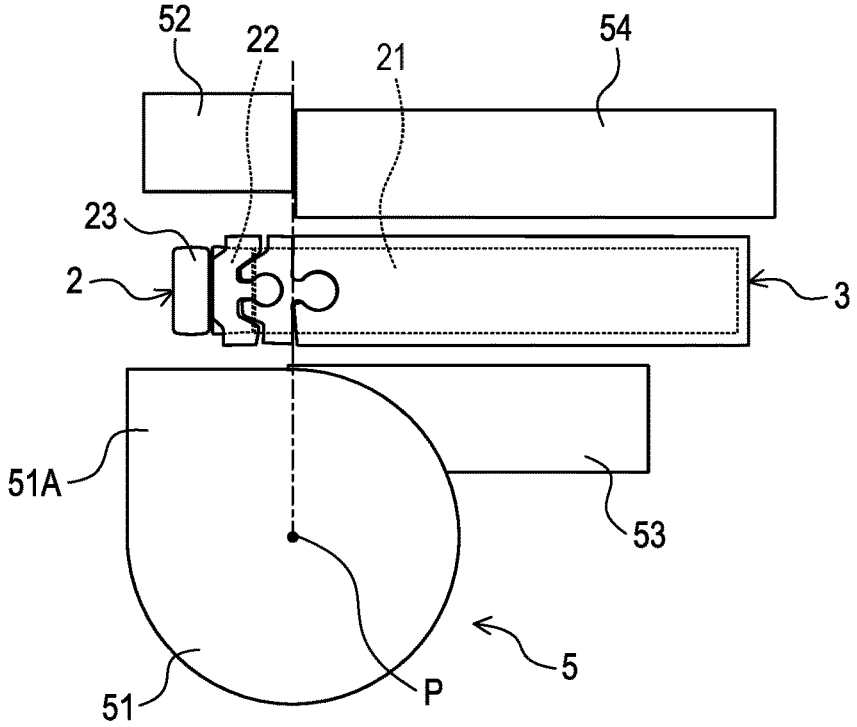
FIG. 10B is a schematic diagram explaining a subsequent process after FIG. 10A.

Then, the double pipe 110 is removed from the inner core metal 2 and the intermediate core metal 3. Finally, as shown in FIG. 10B, the inner core metal 2, the intermediate core metal 3 and the bending mold 5 are returned to an initial position (i.e. to a position where the double pipe 110 can be inserted).

1-3. Effect

According to the above embodiment, effects described below can be obtained.

(1a) The first inner movable portion 22, which is arranged between the inner core metal body 21 and the second inner movable portion 23, presses the inner surface of the first pipe 101 outward in the radial direction when pulled out from the first pipe 101. As a result, the buckling generated in the first pipe 101 is smoothed, and thus, the buckling can be reduced when the first pipe 101 is bent.

(1b) The enlarging diameter portion 22D is smoothly enlarged in diameter toward the second inner movable portion 23 so that the amount of change in the outer diameter per unit length in the axial direction increases. With this configuration, the inner surface of the first pipe 101 is bent along an outer circumferential surface of the first inner movable portion 22 during the bending process of the first pipe 101, and thus, the generation of the buckling can be reduced.

(1c) Use of the inner core metal 2 and the intermediate core metal 3 effectively reduces the buckling in the bending process of the double pipe 110, even though the buckling tends to occur inside the double pipe 110 where the bending mold 5 does not touch during the bending process of the double pipe 10.

(1d) The second inner movable portion 23 is smoothly reduced in diameter from the intermediate portion 23C toward each of the first end 23A and the second end 23B. This allows the second inner movable portion 23 to come in surface contact with the inner surface of the outer curve in the bent portion of the first pipe 101, and allows the first inner movable portion 22 to come in surface contact with the inner surface of the inner curve. Thus, flattening of the first pipe 101 can be reduced.

(1e) The maximum outer diameter of the first inner movable portion 22 is equal to the maximum outer diameter of the second inner movable portion 23. This allows the second inner movable portion 23 to easily abut the inner surface of the outer curve in the bent portion of the first pipe 101. Thus, the flattening of the first pipe 101 can be reduced.

2. Other Embodiments

The embodiment of the present disclosure has been described; however, the present disclosure is not limited to the above-described embodiment, and it is clear that the present disclosure can be implemented in various modifications.

(2a) In the device for manufacturing a bent pipe in the above embodiment, the enlarging diameter portion of the first inner movable portion is not necessarily smoothly enlarged in diameter so that the amount of change in the outer diameter per unit length in the axial direction increases toward the second inner movable portion. For example, the first inner movable portion may have a tapered shape that is continuously enlarged in diameter at a constant rate from the second end to the first end.

In addition, the first inner movable portion may be smoothly enlarged in diameter toward each of the first end and the second end from the intermediate portion. In other words, the first inner movable portion may have an hourglass shape in which the intermediate portion is recessed in the radial direction.

(2b) The pipe, which is bent by the device for manufacturing a bent pipe according to the above embodiment, may not be limited to a double pipe. The method for manufacturing a bent pipe according to the above embodiment may manufacture a bent pipe by use of a single pipe formed of only the first pipe. In other words, the device for manufacturing a bent pipe may not necessarily include the intermediate core metal.

(2c) In the device for manufacturing a bent pipe according to the above embodiment, the second inner movable portion may not be necessarily smoothly reduced in diameter from the intermediate portion in the axial direction toward each of the two ends in the axial direction.

(2d) In the device for manufacturing a bent pipe according to the above embodiment, the maximum outer diameter of the first inner movable portion may not be necessarily equal to the maximum outer diameter of the second inner movable portion.

(2e) In the device for manufacturing a bent pipe according to the above embodiment, the inner core metal may include three or more inner movable portions. Furthermore, the intermediate core metal may include one or three or more intermediate movable portions.

(2f) The functions of one element of the above embodiments may be distributed to a plurality of elements. Functions of a plurality of elements may be integrated to one component. A part of the configurations of the above embodiments may be omitted. At least a part of the configurations of the above embodiments may be added to or replaced with the configurations of the other embodiments. Any embodiment included in the technical ideas defined by the language of the claim is an embodiment of the present disclosure.

What is claimed is:

1. A device for manufacturing a bent pipe, the device comprising:

an inner core metal configured to be arranged inside a first pipe; and a bending mold configured to bend the first pipe containing the inner core metal;

the inner core metal comprising:

an inner core metal body having a hollow cylindrical shape or a solid cylindrical shape;

a first inner movable portion having a hollow cylindrical shape or a solid cylindrical shape, the first inner movable portion being coupled to an end in an axial direction of the inner core metal body, the first inner movable portion being swingable relative to the inner core metal body around a first rocking shaft orthogonal to a central axis of the inner core metal body; and a second inner movable portion having a hollow cylindrical shape or a solid cylindrical shape, the second inner movable portion being coupled to the first inner movable portion on an opposite side of the inner core metal body with the first inner movable portion interposed between the inner core metal body and the second inner movable portion, the second inner movable portion being swingable relative to the first inner movable portion around a second rocking shaft parallel to the first rocking shaft, the first inner movable portion having an enlarging diameter portion enlarged in diameter toward the second inner movable portion, a first end located near the second inner movable portion in an axial direction of the first inner movable portion, and a second end located on an opposite side of the first end, the first end having a first outer diameter larger than a second outer diameter that is an outer diameter of the second end and a third outer diameter in an intermediate location between the first end and the second end, an outer diameter of the first end being equal to a maximum outer diameter of the second inner movable portion, the enlarging diameter portion being smoothly enlarged in diameter so that an amount of change in an outer diameter per unit length in an axial direction increases toward the second inner movable portion, the bending mold being configured to cause an inner surface of the first pipe to press the first inner movable portion and the second inner movable portion.

2. The device for manufacturing a bent pipe according to claim 1, the device further comprising an intermediate core metal configured to be arranged between the first pipe and a second pipe containing the first pipe, wherein the intermediate core metal comprises:

an intermediate core metal body having a hollow cylindrical shape; and an intermediate movable portion having a hollow cylindrical shape, the intermediate movable portion being coupled to an end in an axial direction of the intermediate core metal body, the intermediate movable portion being swingable relative to the intermediate core metal body around a third rocking shaft orthogonal to a central axis of the intermediate core metal body.

3. The device for manufacturing a bent pipe according to claim 1, wherein the second inner movable portion is smoothly reduced in diameter from an intermediate portion in an axial direction toward each of two ends in the axial direction.

4. The device for manufacturing a bent pipe according to claim 1, wherein the first inner movable portion has a maximum outer diameter equal to a maximum outer diameter of the second inner movable portion.

5. The device for manufacturing a bent pipe according to claim 1, wherein the first inner movable portion further includes a straight portion, the straight portion having a constant outer diameter at the first end.

6. A method for manufacturing a bent pipe, the method comprising:

arranging an inner core metal inside a first pipe; and bending the first pipe containing the inner core metal, the inner core metal comprising:

an inner core metal body having a hollow cylindrical shape or a solid cylindrical shape;

a first inner movable portion having a hollow cylindrical shape or a solid cylindrical shape, the first inner movable portion being coupled to an end in an axial direction of the inner core metal body, the first inner movable portion being swingable relative to the inner core metal body around a first rocking shaft orthogonal to a central axis of the inner core metal body; and a second inner movable portion having a hollow cylindrical shape or a solid cylindrical shape, the second inner movable portion being coupled to the first inner movable portion on an opposite side of the inner core metal body with the first inner movable portion interposed between the inner core metal body and the second inner movable portion, the second inner movable portion being swingable relative to the first inner movable portion around a second rocking shaft parallel to the first rocking shaft, the first inner movable portion having an enlarging diameter portion enlarged in diameter toward the second inner movable portion, a first end located near the second inner movable portion in an axial direction of the first inner movable portion, and a second end located on an opposite side of the first end, the first end having a first outer diameter larger than a second outer diameter that is an outer diameter of the second end and a third outer diameter in an intermediate location between the first end and the second end, an outer diameter of the first end being equal to a maximum outer diameter of the second inner movable portion, the enlarging diameter portion being smoothly enlarged in diameter so that an amount of change in an outer diameter per unit length in an axial direction increases toward the second inner movable portion, wherein an inner surface of the first pipe presses the first inner movable portion and the second inner movable portion during the bending.

7. The method for manufacturing a bent pipe according to claim 6, wherein the first inner movable portion further includes a straight portion, the straight portion having a constant outer diameter at the first end.

* * * * *